United States Patent [19]

Mitchard

[11] Patent Number: 4,946,540

[45] Date of Patent: Aug. 7, 1990

[54] APPARATUS FOR THE MANUFACTURE OF LAMINATED BULK BOXES

[75] Inventor: John M. Mitchard, Cherry Hill, N.J.

[73] Assignee: Union Camp Corporation, Wayne, N.J.

[21] Appl. No.: 272,088

[22] Filed: Nov. 16, 1988

[51] Int. Cl.[5] ..... B65B 41/00

[52] U.S. Cl. ..... 156/556; 156/364; 156/557; 493/96

[58] Field of Search ..... 156/297–300, 156/556, 558, 559, 563, 364; 493/93–97

[56] References Cited

U.S. PATENT DOCUMENTS

| | | | |
|---|---|---|---|
| 3,483,065 | 12/1969 | O'Brien | 156/364 X |
| 3,725,183 | 4/1973 | Brookhyser | 156/563 |
| 4,608,038 | 8/1986 | Virta et al. | 493/96 X |

*Primary Examiner*—David Simmons

*Attorney, Agent, or Firm*—Edward J. Sites

[57] ABSTRACT

Novel apparatus for assembling box blanks and liners are provided. The apparatus includes supports for stacks of box blanks and liners and a laminating table disposed to receive blanks and liners from the supports. Also included is shuttle apparatus disposed between the supports and the laminating table for gripping and lifting the blanks and liners and taking blanks and liners from the supports to the laminating table and placing them in proper registration. The shuttle apparatus can further include means for dropping the liner onto the blank prior to final registration. The invention is highlighted by a single pushing mechanism for aligning both the blank and liner in a single direction. The invention further includes adhesive applying apparatus which minimizes maintenance due to adhesive overspray and indexing carriers which minimize registration errors.

23 Claims, 6 Drawing Sheets

APPARATUS FOR THE MANUFACTURE OF LAMINATED BULK BOXES

FIELD OF THE INVENTION

This invention relates to an improvement in the manufacture of laminated boxes, and more particularly to the application of a liner to a blank of a bulk box for use in shipping heavy loads.

BACKGROUND OF THE INVENTION

A bulk box or bin is a large container normally used for bulk shipment of flowable materials, e.g. plastic resin, chemicals, powders, vegetables, etc. The range of capacities for this class of containers is about 800–2200 lbs., however, the most common size is about 1000 lbs. Often, during storage, several of these relatively large boxes are loaded one on top of the other in multi-tier fashion.

The stacking strength needed for multi-tier storage of bulk boxes is achieved by reinforcing the side walls of the container with additional plies of corrugated material, commonly called liners. In order for the multiple layers of material in the construction of the box to be effective, it is essential that the plies be tightly bonded to one another with adhesive. In addition, the inner reinforcement must be accurately placed relative to the outer blank to insure that, in the erected condition, the loading will be distributed equally to all sides of the box.

Bulk boxes vary in size and construction depending on the specific application. The corrugated material may be constructed using a variety of flutes and basis weights of constituent parts, as well as a number of inner reinforcing plies or liners. While the most common box is a rectangular design, boxes having as many as eight sides have been employed. The outer blanks of bulk boxes can range in size from 43 to about 96 square feet. A finished box can weigh as much as 40 lbs. in the unloaded condition. The size and weight of the component parts has resulted in a very slow and frequently labor intensive manufacturing process.

One such assembly process is described in my patent, U.S. Pat. No. 3,964,953, which is hereby incorporated by reference. This prior art procedure provides an apparatus which alternatively picks up and places liners and blanks in acceptable registration for lamination. This is accomplished, in part, by a vacuum cup suspension system in combination with the shuttle arrangement. A glue spray station is also used to apply adhesive to the liner prior to assembly.

While prior art bulk box manufacturing has produced acceptable product, there is still a need for higher quality and greater productivity. The assembly operation requires high accuracy to assure that the liner and blank align properly to provide optimum strength. However, current alignment procedures can be inconsistent, and overspray from glue spray stations can often complicate the maintenance of the system.

Accordingly, there is a current need for a highly accurate and fully automated blank-liner assembly apparatus.

SUMMARY OF THE INVENTION

A novel apparatus for assembling a liner to a blank for boxes is provided by this invention. The apparatus cuts down on the number of movements necessary to properly register the blank with its liner prior to assembly. In an important aspect of the invention, a single pushing means is employed to register both the blank and liner in a first, and more preferable in a cross-machine direction. Other features of this invention include shuttle means for gripping and lifting the blanks and liners and transferring them to a laminating table for assembly. In preferred embodiments, the shuttle means comprises a shuttle apparatus for the blanks movable in a first direction, and a second shuttle means for moving the liners in a second direction. Squaring switches are employed for determining when the blank and liner are in proper registration. Additionally, an adhesive roll coater is employed to avoid the unnecessary maintenance caused by adhesive spraying stations employed by prior art apparatus.

Accordingly, the invention can assemble a bulk box blank and its liner in about 8 seconds. The apparatus is designed to accommodate multiple liners on a single blank and can be adjusted to assemble various sized boxes, large or small. The overall precision of the assembly procedure is increased with this device to a tolerance of about 1/16" per 8 feet of corrugated material. Accordingly, the overall integrity of bulk boxes, and other boxes, manufactured using this apparatus, is increased.

It is, therefore, an object of this invention to provide a box manufacturing apparatus for applying a liner to a blank with increased accuracy.

It is another object of this invention to provide an apparatus for laminating a liner to a blank without the maintenance cost associated with adhesive overspray.

It is still another object of this invention to provide more efficient registration between a liner and a blank during assembly.

With these and other objects in view, which will become apparent to one skilled in the art as the description proceeds, this invention resides in the novel construction, combination, arrangement of parts, and methods substantially as hereinafter described and more particularly defined by the attached claims.

BRIEF DESCRIPTION OF THE DRAWINGS

The accompanying drawings illustrate a preferred embodiment of the invention devised for the practical application of the principles thereof, and in which.

DETAILED DESCRIPTION OF THE INVENTION

Figure 1:
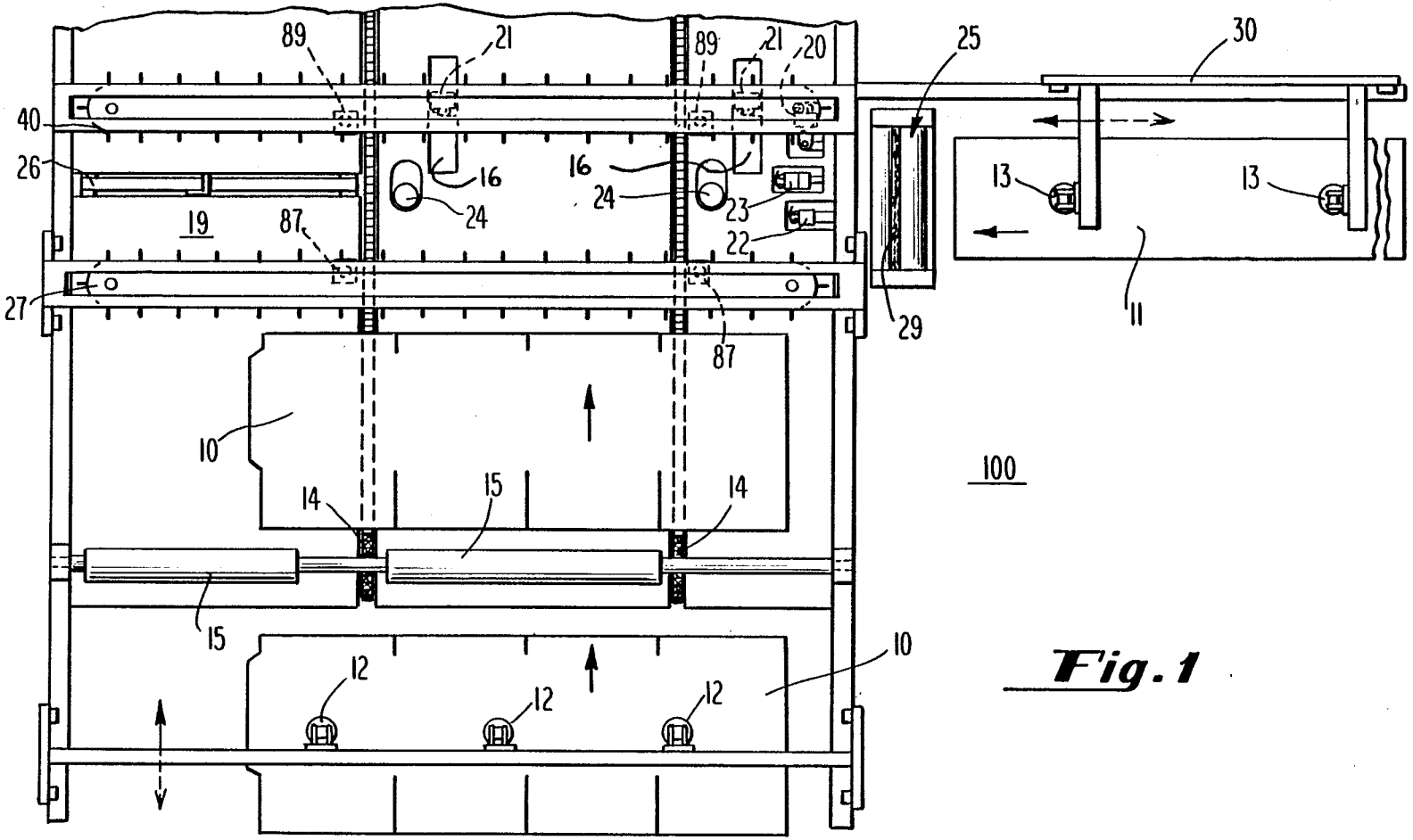
FIG. 1: is a top elevation, partial plan view of the preferred apparatus of this invention showing blanks and a liner being moved to the laminating table.

The operative embodiments espousing the principal objects of this invention will now be described. In one preferred embodiment of this invention, the apparatus includes supports for stacks of box blanks and liners and a laminating table disposed to receive the blanks and liners from these supports. A shuttle means is disposed between the supports and the laminating table and includes means for gripping and lifting the blanks and liners and is adapted to take blanks and liners from the stacks on the supports to the laminating table and place a blank in registered position on the laminating table and a liner in registered position on the blank. The shuttle means further comprises blank shuttle means movable in a first direction, liner shuttle means movable in a second direction, and pusher means disposed to register both the blank and the liner in a single direction. The pusher means operates in combination with first stop means projecting upwardly from the laminating table to limit the forward and side motions of the blank and register it in position as it is placed on the laminating table. The pusher means also operates in combination with a second stop means movable into position over the blank which limits the forward and side motions of the liner and register it in position on the blank. The apparatus finally includes adhesive applying means disposed to apply adhesive to the liner as it moves from the stack of liners to the laminating table and means to convey the laminated liner-blank from the laminating table after the assembly operation.

In another embodiment of this invention, the apparatus for laminating the liner to the box blank comprises supports for a stack of box blanks and liners and a laminating table disposed to receive the blanks and liners from the supports. Also included in this embodiment, are blank shuttle means movable in a machine direction and having means for gripping and lifting the blanks from the stacks on the support to the laminating table and liner shuttle means movable in a cross-machine direction having means for gripping and lifting the liner on the support. This embodiment further includes adhesive applying means disposed to apply adhesive to the liner as it moves from the stack of liners to the laminating table, and pusher means disposed to register both the blank and the liner in cross-machine direction. Finally, as indicated in the previous embodiment, this apparatus includes means to convey the laminated liner/blank from the laminating table to the next operation.

The preferred operation of these and other embodiments of this invention will now be described. The two components, blanks and liners, are brought to the laminating apparatus in stacks that can contain about 120–300 sheets, depending upon the construction of the sheets. The supply stack of each component is positioned on a preferred hydraulic scissor lift (not shown) which will lift the stack to bring the top of the stack into the required operating position. This position can be sensed by a photocell looking across the top of the load. The stacks of sheets are conveyed onto the lift table and supported thereon by preferred roller conveyers. The sections of roller conveyers are each preferably 30 inches to about 40 inches wide and are arranged side-by-side across the width of the machine. The spaces between the conveyers provide pockets below the bottom of the stack of sheets into which combing fingers are inserted at the time of replenishment. The fingers support the remaining sheets in the stack while the lift table is lowered to receive the next stack of sheets. Operation of the machine continues uninterrupted using the supply of sheets on the fingers. When they have been depleted, the fingers are withdrawn and the next load is raised to the operating level. Although not illustrated, these mechanisms are well within the understanding and skill of those in the box assembly art.

Referring now to FIG. 1, the apparatus 100 will now be more fully described. Vacuum cups 12 mounted on a movable carriage over the stack of blanks are lowered onto the top of the stack and attached to the top blank sheet 10. The blank sheet 10 is then raised and the carriage moves toward the machine. The leading, or long, edge of the blank 10 passes through the space between a set of preferred feed rolls 15 until a photocell located just downstream of the rolls 15 senses its presence. The carriage stops, the feed rolls 15 close, and the vacuum cups 12 release the blank 10. The feed rolls 15 are rotated to move the blank 10 into the machine "ready" area just before the assembly area. During this period, the carriage moves back to the pick-up position in preparation for the next cycle.

The distance the blank 10 is advanced by the feed rolls 15 is a function of the size of the box being produced. The blank 10 waits for the completion of the assembly operation that is in progress in the next downstream position before the preferred main lug chain 14 will index to move all the units in the line to the next position. When the lug chains 14 start to index, the feed rolls 15 will also start and advance the blank 10 in its nip until the blank 10 clears the nip. The lugs on the lug chain 14 engage the back, or long, edge of the blank 10 and advance it to the assembly area. The lug chain 14 places the downstream, transverse, corrugated score nominally in line with the transverse fixed datum 40 of the apparatus 100.

After the lug chain 14 stops, it is necessary to orient the blank 10 to the machine in preparation for the assembly step that follows. This is accomplished by first moving the blank 10 in a first, preferably cross-machine direction, under the influence of a pusher means, which preferably includes a selectively activated pusher mechanism, and more preferably includes pneumatic activation means 26 and pushing surface 17 disposed in channel 18, substantially as described in FIGS. 2 and 3. The activation of this pusher means continues until the blank 10 contacts first stop means, preferably comprising switch means, e.g. locating stop/limit switch 22.

Figure 4:
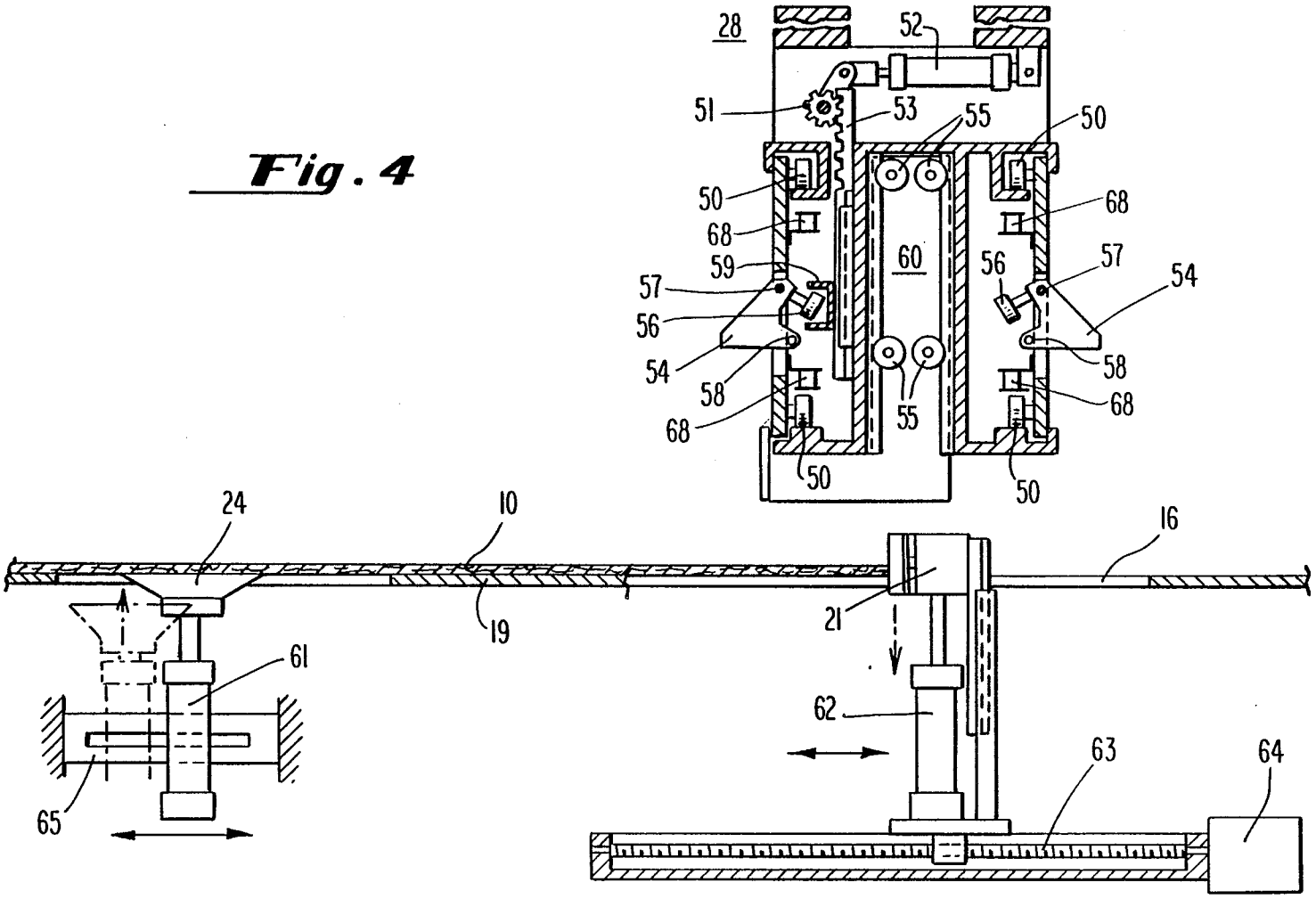
FIG. 4: is an enlarged cross-sectional view, taken through line 4—4 of FIG. 2, illustrating a preferred means for registering the blank in the machine direction, as well as the internal mechanism for the preferred liner shuttle means.

Operation the stop/limit switch 22 causes suction means, preferably vacuum cups 24 in the table 19 below the blank 10 to raise and attach to the blank 10 as shown in FIG. 4. As illustrated, the vacuum cups 24 can be equipped with preferred pneumatic activators 61 and 65 for providing vertical and horizontal motion during service. The vacuum cup or cups 24, or other suitable releasable adhering mechanism, then moves the blank 10 in the machine direction against a preferred pair of stop/limit switches 21. As described in FIG. 4, these switches 21 can be equipped with pneumatic cylinder assembly 62, so that they can be lowered beneath the laminating table 19 after assembly to enable the laminated liner-blank to proceed to the next operation via lug chain 14 or similar means known to those skilled in the art. The switches 21 preferably can be adjustable within slots 1 to provide various positions to accommodate box size. This machine direction adjustment is preferably accomplished by the combination of motor 64 and lead screw 63 which can be activated to cause a translation of the pneumatic cylinder assembly 62 along lead screw 63. The completion of the blank alignment operation, as signaled by the switches 21 in the machine direction, stops the forwarding of the vacuum cup assembly 24.

Figure 2:
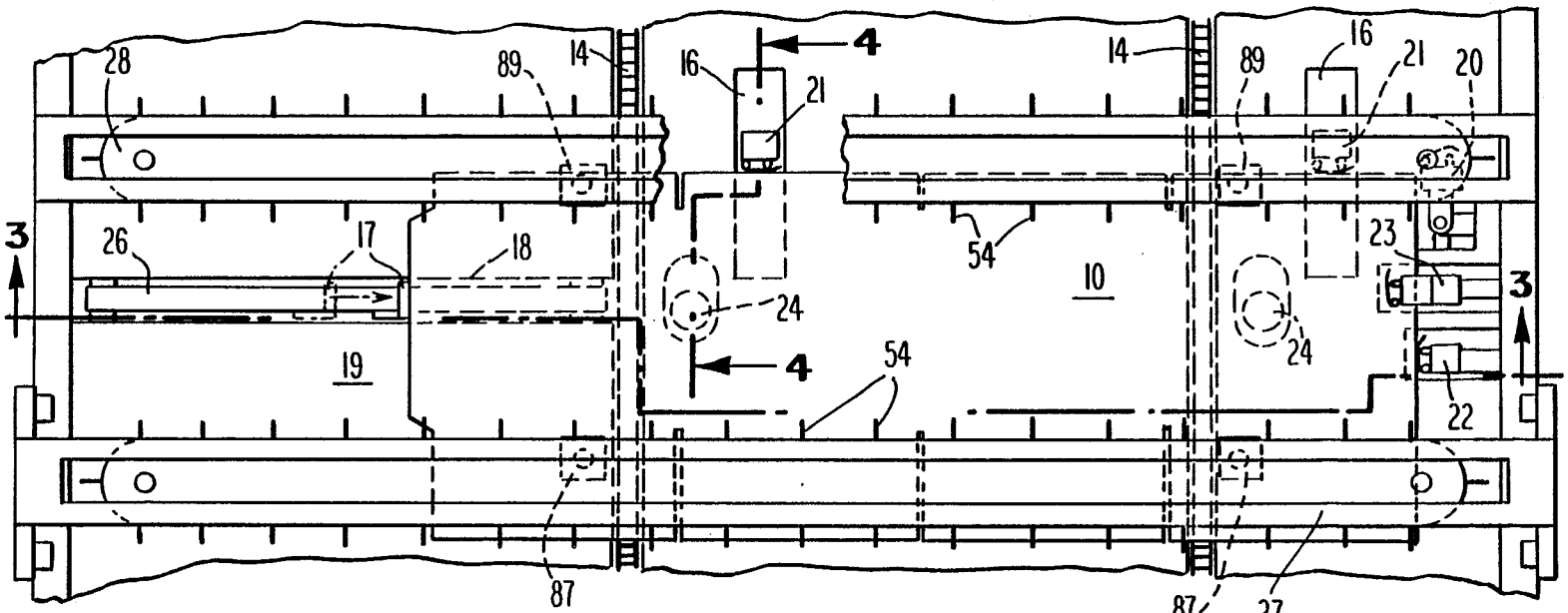
FIG. 2: is an enlarged partial, top plan view of the laminating table portion of FIG. I, illustrating a blank during registration.
Figure 3:
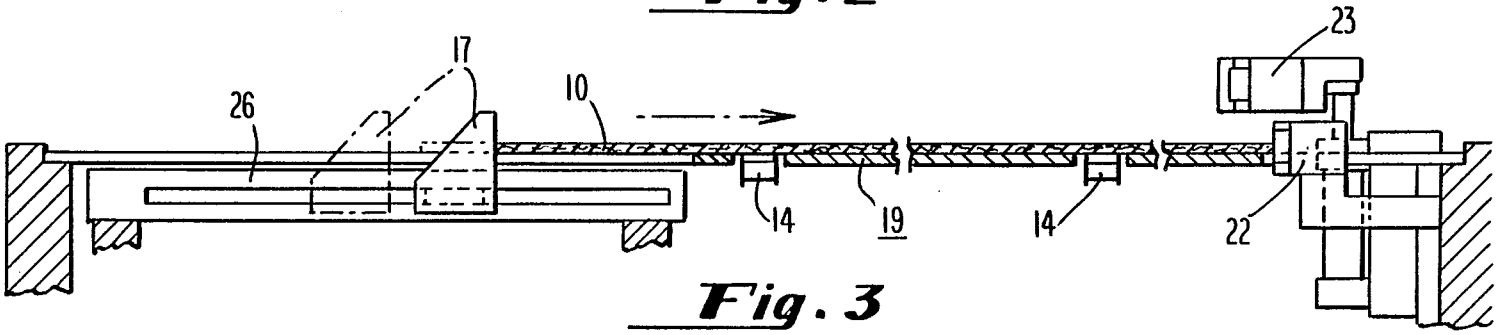
FIG. 3: is an enlarged cross-sectional view, taken through line 3—3 of FIG. 2, illustrating the registration of the blank in the cross-machine direction.

Following the alignment of the blank 10, a preferred transverse stop/limit switch 23 of the second stop means is moved into a position over the blank, preferably at the machine direction datum line along the narrow dimension of the blank, in preparation for the subsequent placement of the liner 11. In the preferred bulk box embodiment, the stop/limit surface of this switch 23 is disposed approximately 4 inches from the transverse edge of the blank 10. When multiple liners are required, a second transverse stop/limit switch 20 can be activated, preferably by pneumatic means about a pivot point, as shown in FIGS. 1 and 2. The second switch 20 permits the alignment of a second liner in a cross-machine direction using the same transverse pushing means. Preferably, the second switch 20 is disposed about 8 inches from the transverse edge of the blank 10.

The feeding of the liner 11 will now be described. The liner 11 enters the machine at preferred right angles to the direction of travel of the blank 10, with the short dimension as the leading edge. As before, vacuum cups 13, as part of the overall shuttle means, are lowered to the top of the stack of the liners 11 which has already been positioned at the correct elevation in the manner similar to the blank feed. The cups 13 attach to the top sheet 11, lift it from the stack 67, and move it in the direction to bring its long dimension against a set of stop/limit switches that align it parallel to, and nominally in line with, the fixed transverse datum referred to in the previous section. When the alignment is sensed by limit switches, the carriage 30 of the liner shuttle means on which the vacuum cups are mounted advances the liner toward the nip of the roller adhesive means.

The roller adhesive means preferably includes a plurality of feed rollers 25, with at least one of the rollers disposed in contact with an adhesive bath 29. As described, the roll coater is preferably disposed between the carriage 30 and the carriers 27 and 28. After the liner 11 is taken from stack 67 by a vacuum cup assembly 13, it is carried through the glue application station which includes rollers 25 and glue bath 29.

Figure 5:
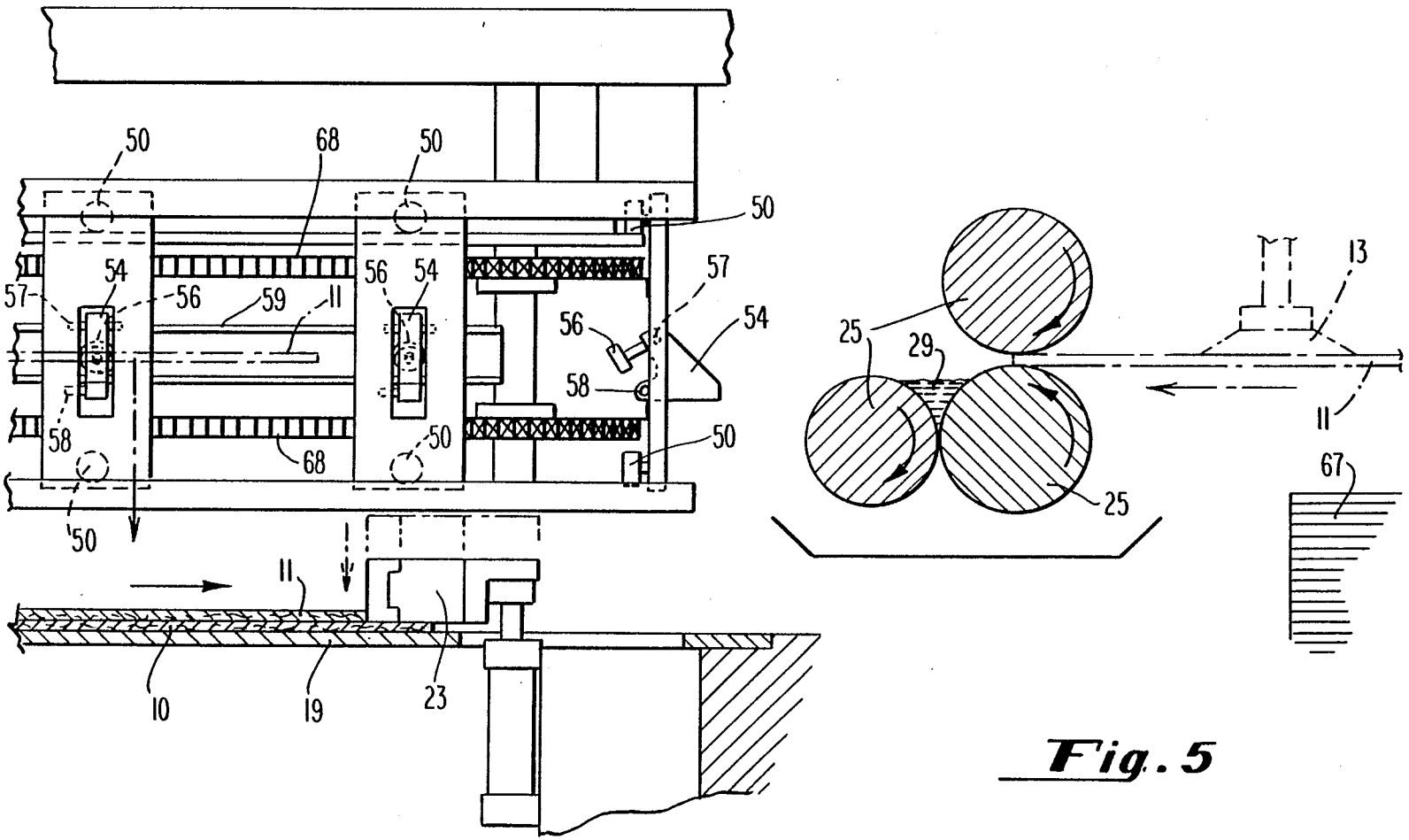
FIG. 5: is an enlarged, cross-sectional view of a preferred adhesive application station, liner shuttle means and stop means for registering the liner in a cross-machine direction.
Figure 6:
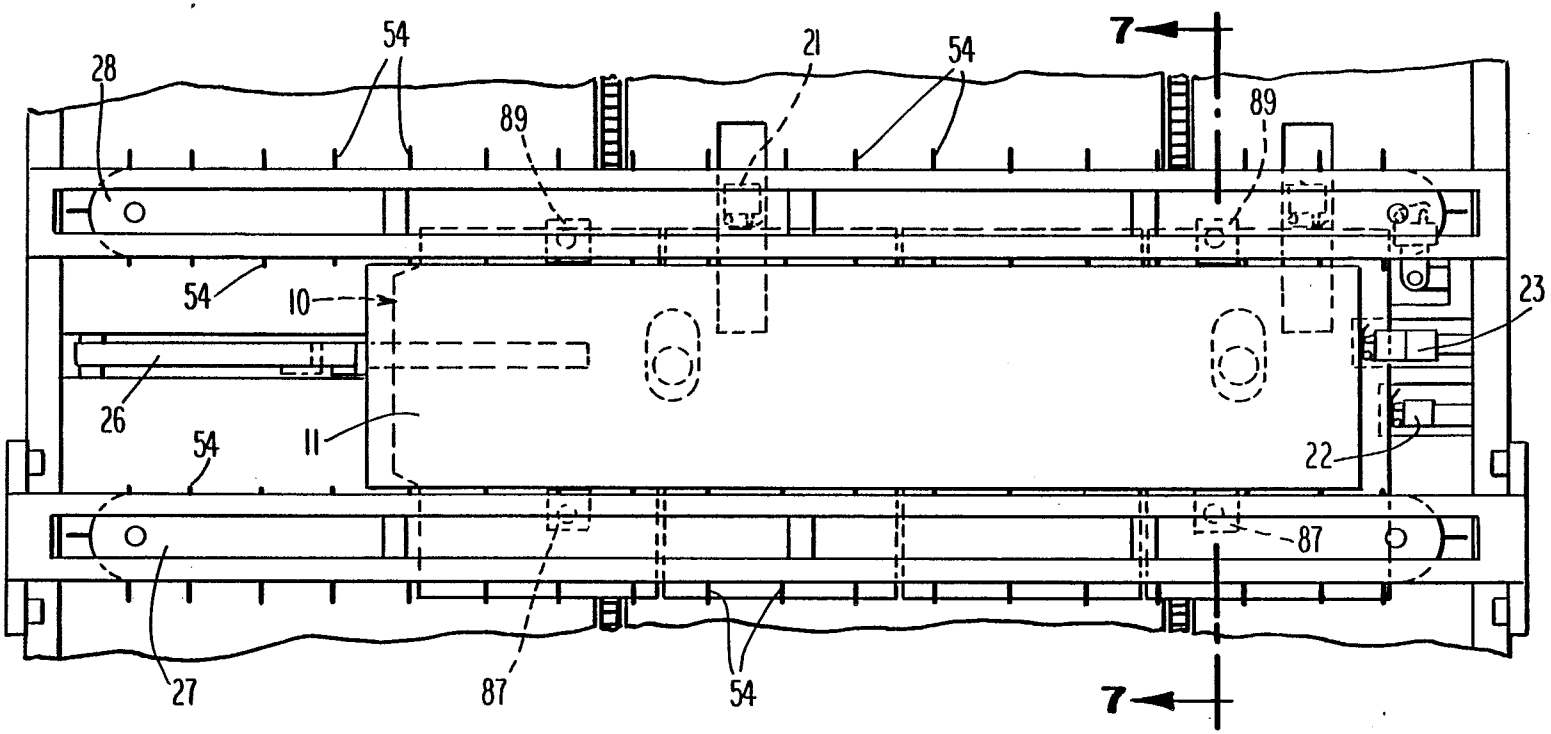
FIG. 6: is an enlarged, top plan view of the laminating table of FIG. 1, illustrating the registration of the liner on the blank.
Figure 7:
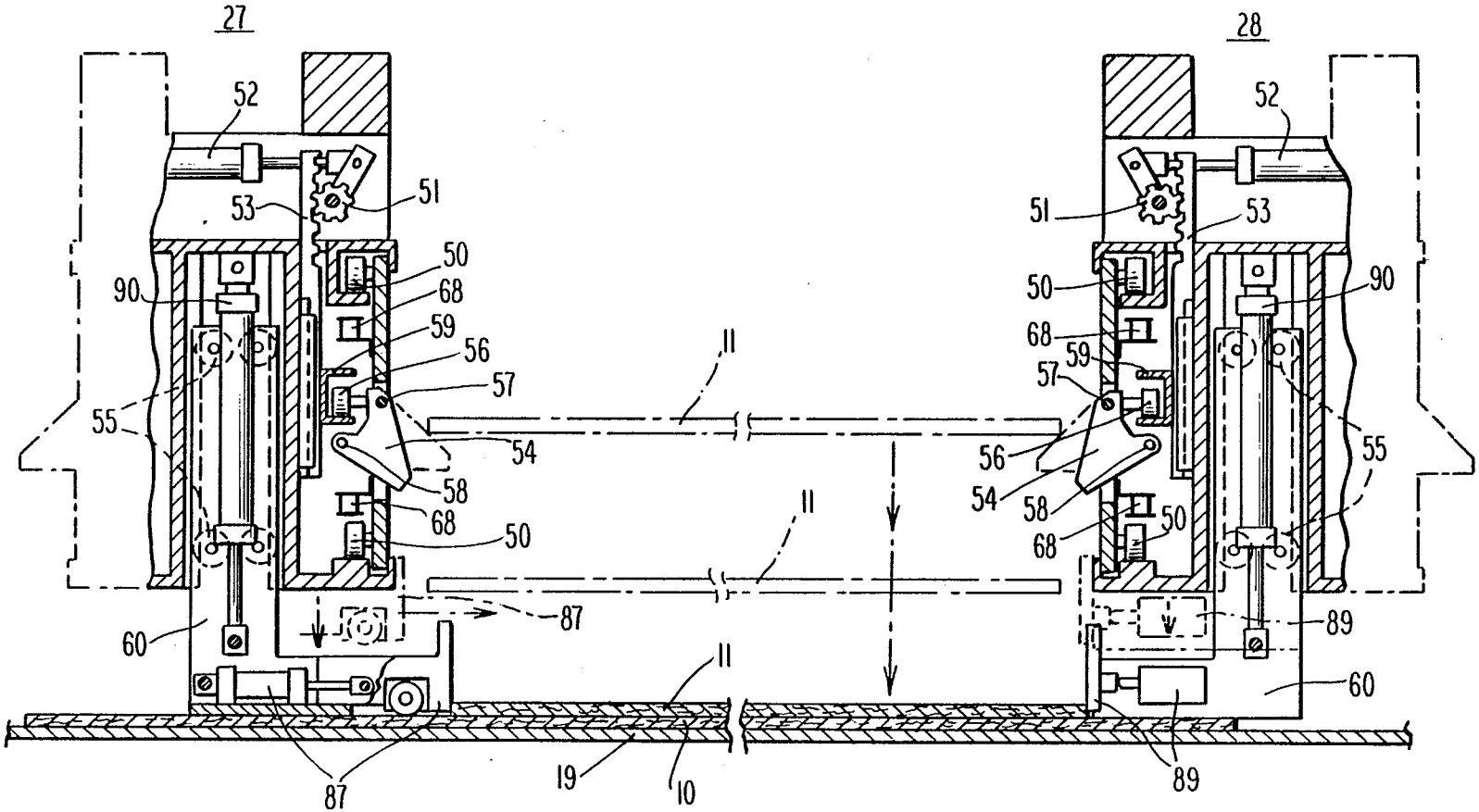
FIG. 7: is an enlarged, cross-sectional view of the preferred liner shuttle means releasing a liner onto the laminating table and further illustrating the registration of the liner in a machine direction.

With reference to FIGS. 4, 5 and 7, the preferred liner shuttle means will now be described. The liner shuttle means, as illustrated, preferably includes carriers 27 and 28 which are spaced apart to suit the dimensions of the liner. The downstream carrier 28 is preferably fixed in position and forms the fixed transverse datum. The upstream carrier 27 is adjustable and is positioned to suit the size requirements of the product. The carriers conveyors 27 and 28 have nose-shaped projections 54, which make up part of the pivoting holding means. The projections 54 are spaced along their length to receive the coated liner 11 and support it along its edge, thus leaving the adhesive pattern undisturbed.

The plurality of nose-shaped projections 54 of a pivoting holding means carries the liner from the adhesive applying means to a position above the laminating table 19. The nose-shaped projections 54 are indexed along the carriers 27 and 28 with indexing chains 68 so that they roll along supporting channels on rollers 50. When the liner is being carried, the nose-shaped projections 54 are disposed substantially as described in FIG. 4. When the trailing edge of the liner 11 clears the adhesive coater and passes under a photocell, it signals the carriers 27 and 28 to stop with the liner positioned nominally over the blank 10.

As the liner 11 is being advanced, clamping assemblies 60 which also preferably include switch means and machine direction pusher means as described in FIG. 7, descend from carriers 27 and 28 onto the blank. This is preferably accomplished by activation of pneumatic means 90, which lowers the clamping assemblies 60 along rollers 55. In the preferred embodiment a switch means 89 is disposed within the clamping assembly of carrier 28, and a machine direction pusher means 87 is disposed within the clamping assembly of carrier 27. When the trailing edge of the liner 11 clears the feed rollers of the roller adhesive means and passes under a photocell, it signals the carriers 27 and 28 to stop with the liner position nominally over the blank 10. When the carriers 27 and 28 stop, a signal is given to the pivoting holding means which preferably includes elements 51, 52, 53, 54, 56, 57, 58, and 59. This triggers pneumatic means 52 to activate the rack and pinion mechanism comprising rack 53 and gear 51 to lift the channel 59 to contact the weighted roller 56. This causes the nose-shaped projection 54 to rotate downward about pivot point 57, releasing the liner. After the liner 11 has been dropped on the blank 10, pneumatic means 52 is again activated to cause the rack and pinion means to lower the channel 59, thereby freeing the nose-shaped projections 54 counterweighted by the weighted roller 56. The nose-shaped projections 54 rotate outwardly until stopping pin 58 comes in contact with the sidewall of the carrier.

When the liner 11 settles onto the blank 10, the same transverse pusher means, or pneumatic activation means 26 used to align the blank 10, now moves against the liner 11 and pushes it until it contacts the preferred stop/limit switch 23, satisfying the transverse alignment. At this point, the machine direction pusher means 87, which was lowered earlier from the liner carrier 27 of the liner shuttle means, is applied until the liner 11 rests against the switches 89. Completion of this operation fully aligns the liner 11 to the blank 10 in both the transverse and machine direction. If additional liners are required for the customer's requirements, the sequence can be repeated.

From the foregoing it can be realized that this invention provides an improved apparatus for applying a liner to a blank with increased accuracy. The apparatus further reduces the maintenance cost associated with cleaning adhesive overspray and provides greater efficiency by employing a single pushing mechanism for aligning both the blank and the liner in a preferred cross-machine direction. Although various embodiments have been illustrated, this was for the purpose of describing, but not limiting the invention. Various modifications, which will become apparent to one skilled in the art, are within the scope of this invention described in the attached claims.

I claim as my invention:

1. In an apparatus for laminating a liner to a blank, said apparatus having supports for stacks of box blanks and liners, a laminating table disposed to receive said blanks and liners, shuttle means disposed between said supports and said laminating table, said shuttle means having means for gripping and lifting said blanks and liners and being adapted to take alternately blanks and liners from said stacks on said supports to said laminating table and place a blank in registered position on the laminating table and a liner in registered position on the blank, first stop means projecting upwardly from the laminating table to limit the forward and side motions of the blank and register it in position as it is placed on the laminating table, second stop means movable into position over the blank to limit the forward and side motions of the liner and register it in position on the blank, adhesive applying means disposed to apply adhesive to the liner as it moves from the stack of liners to the laminating table, and means to convey the laminated liner-blank from the laminating table, wherein said shuttle means of said apparatus comprises:

blank shuttle means movable in a first direction;

liner shuttle means movable in a second direction, and pusher means disposed to successively register both said blank and liner in a cross-machine direction on said laminating table.

2. The apparatus of claim 1 wherein said adhesive applying means comprises roller adhesive means.

3. The apparatus of claim 2 wherein said roller adhesive means comprises a plurality of feed rollers and an adhesive bath, at least one of said plurality of feed rollers disposed to contact said adhesive bath.

4. The apparatus of claim 1 wherein said pusher means comprises a selectively activated pusher mechanism.

5. The apparatus of claim 4 wherein said pusher mechanism comprises pneumatic activation means.

6. The apparatus of claim 1 wherein said blank shuttle means comprises suction means for lifting and registering said blank in a machine direction.

7. The apparatus of claim 6 wherein said first stop means comprises switch means for detecting when said blank is registered in a machine direction.

8. The apparatus of claim 7 wherein said switch means is adapted to be lowered beneath said laminating table.

9. The apparatus of claim 1 wherein said second stop means comprises a switch means for detecting when said liner is registered in a machine direction.

10. The apparatus of claim 9 wherein said second stop means comprises switch means for detecting when said liner is registered in a cross-machine direction.

11. The apparatus of claim 10 wherein each of said switch means of said second stop means is disposed to selectively engage a surface of said liner.

12. The apparatus of claim 1 wherein said liner shuttle means comprises pivoting holding means for carrying said liner from said adhesive applying means to a position above said laminating table.

13. The apparatus of claim 12 wherein said pivoting holding means comprises rack and pinion activation means for activating said pivoting holding means from a liner holding position to a liner releasing position.

14. The apparatus of claim 12 wherein said pivoting holding means comprises means for dropping said liner onto said blank.

15. The apparatus of claim 14 wherein said clamping assembly means comprises pneumatic means for providing vertical motion to said clamping assembly means.

16. The apparatus of claim 15 wherein said clamping assembly means comprises pusher means for registering said liner in a machine direction.

17. The apparatus of claim 16 wherein said clamping assembly means comprises switch means for detecting when said liner is registered in a machine direction.

18. An apparatus for laminating a liner to a blank, comprising:

(a) a support for a stack of box blanks;

(b) a support for a stack of liners;

(c) a laminating table disposed to receive said blanks and liners from supports;

(d) blank shuttle means movable in a machine direction and having means for gripping and lifting said blanks from said stacks on said support to said laminating table;

(e) liner shuttle means movable in a cross-machine direction having means for gripping and lifting said liner on said support;

(f) adhesive applying means disposed to apply adhesive to the liner as it moves from the stack of liners to the laminating table;

(g) pusher means disposed to successively register both said blank and said liner in a cross-machine direction on said laminating table; and (h) means to convey the laminated liner-blank from the laminating table.

19. The apparatus of claim 18 wherein said apparatus further comprises first stop means projecting upwardly from the laminating table to limit the forward and side motions of the blank and register it in position as it is placed on the laminating table.

20. The apparatus of claim 19 further comprising second stop means movable into position over the blank to limit the forward and side motions of the liner and register it in a position on said blank.

21. The apparatus of claim 20 wherein said second stop means comprises switch means disposed to descend from said liner shuttle means onto said blank.

22. The apparatus of claim 21 wherein said second stop means comprises machine direction pusher means disposed to descend from said liner shuttle means onto said blank.

23. In an apparatus for laminating a liner to a blank, said apparatus having supports for stacks of box blanks and liners, a laminating table disposed to receive said blanks and liners, shuttle means disposed between said supports and said laminating table, said shuttle means having means for gripping and lifting said blanks and liners and being adapted to take blanks and liners from said stacks on said supports to said laminating table and place a blank in registered position on the laminating table and a liner in registered position on the blank, first stop means projecting upwardly from the laminating table to limit the forward and side motions of the blank and register it in position as it is placed on the laminating table, second stop means movable into position over the blank to limit the forward and side motions of the liner and register it in position on the blank, adhesive applying means disposed to apply adhesive to the liner as it moves from the stack of liners to the laminating table, and means to convey the laminated liner-blank from the laminating table, wherein said shuttle means further comprises:

a pair of liner carriers for transferring said liner to said laminating table, said carriers comprising spaced projections for receiving and supporting a coated liner and clamping assembly means disposed to selectively engage said blank.

* * * * *